US005142953A

United States Patent [19]

Lin

[11] Patent Number: 5,142,953

[45] Date of Patent: Sep. 1, 1992

[54] RATCHET SCREW DRIVER

[76] Inventor: Chi-Yeh Lin, No. 5-11, Lane 42, Jenhua Rd., Jenhua Tsun, Tali Hsiang, Taichung Hsien, Taiwan

[21] Appl. No.: 765,148

[22] Filed: Sep. 25, 1991

[51] Int. Cl.[5] ..... B25B 13/46

[52] U.S. Cl. ..... 81/63; 81/63.2

[58] Field of Search ..... 81/29, 31, 58.4, 60, 81/63, 63.2; 192/43–43.2

[56] References Cited

U.S. PATENT DOCUMENTS 4,170,909 10/1979 Wagner ..... 81/63.2
4,770,071 9/1988 Steier ..... 81/63
4,901,607 2/1990 Beugelsdyk et al. ..... 81/63.2

*Primary Examiner*—James G. Smith
*Attorney, Agent, or Firm*—Fitch, Even, Tabin & Flannery

[57] ABSTRACT

A screw driver including a sleeve having a handle coupled to one end and having a number of teeth formed in the inner surface, a shaft rotatably received in the sleeve, a pawl rotatably engaged in the head, a rod rotatably received in the shaft, a spring and a ball received in the rod and the ball being biased to engage with the pawl, a knob engaged on the shaft, a post engaged through the knob and the shaft and the rod so that the rod can be rotated by the knob, and the pawl being caused to engage with the teeth of the sleeve when the rod is rotated in either direction.

2 Claims, 4 Drawing Sheets

RATCHET SCREW DRIVER

BACKGROUND OF THE INVENTION (a) Field of the Invention

The present invention relates to a screw driver, and more particularly to a screw driver which is capable of selecting rotational directions.

(b) Description of the Prior Art

Screw driver usually comprises a handle portion and a tool fixed together and rotated in concert. When driving a screw or a bolt, the tool should be engaged within a recess of the screw so as to rotate the screw. However, in order to further rotate the screw, the tool should be disengaged from the recess and rotated with an angle and engaged with the recess again so that the screw can further be rotated. This is inconvenient.

The present invention has arisen to mitigate and/or obviate the afore-described disadvantages of the conventional screw drivers.

SUMMARY OF THE INVENTION

The primary objective of the present invention is to provide a screw driver whose rotational directions can be selected and which can continuously be operated without disengagement from the recess of the screw.

In accordance with one aspect of the present invention, there is provided a screw driver which includes a sleeve having a handle coupled to one end and having an open end and having a number of teeth formed in the inner surface, a head rotatably received in the sleeve, a pawl rotatably engaged in the head and having two abutments, a shaft and a socket formed integral with the head and extended outward beyond the open end of the sleeve, a rod rotatably received in the head and the shaft, a spring and a ball received in the rod and the ball being biased to engage with the pawl, a knob engaged on the shaft, a post engaged through the knob and the shaft and the rod so that the rod can be rotated by the knob. One of the abutments can be caused to engage with the teeth of the sleeve when the rod is rotated in one direction so that the screw driver can rotate in only one direction.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
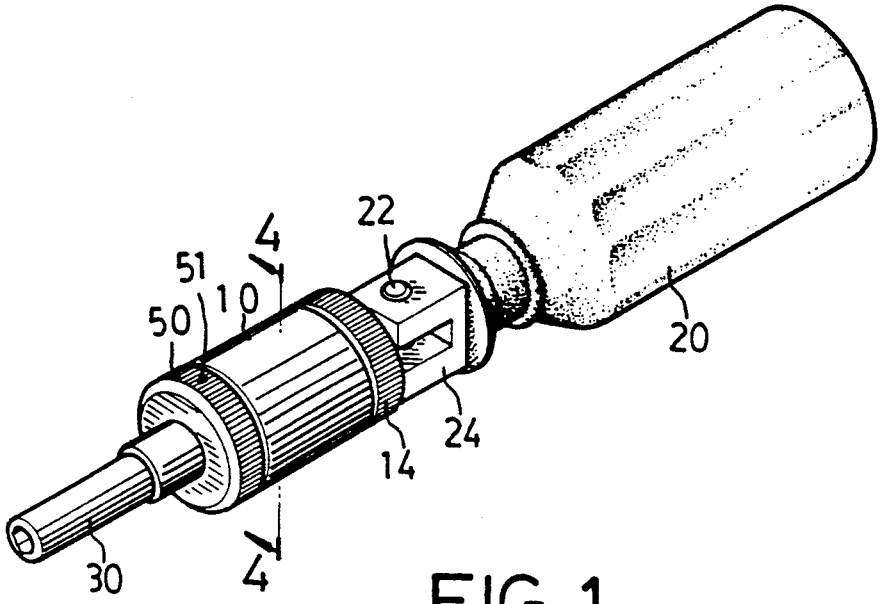
FIGS. 1 and 2 are perspective views of a screw driver in the present invention.
Figure 2:
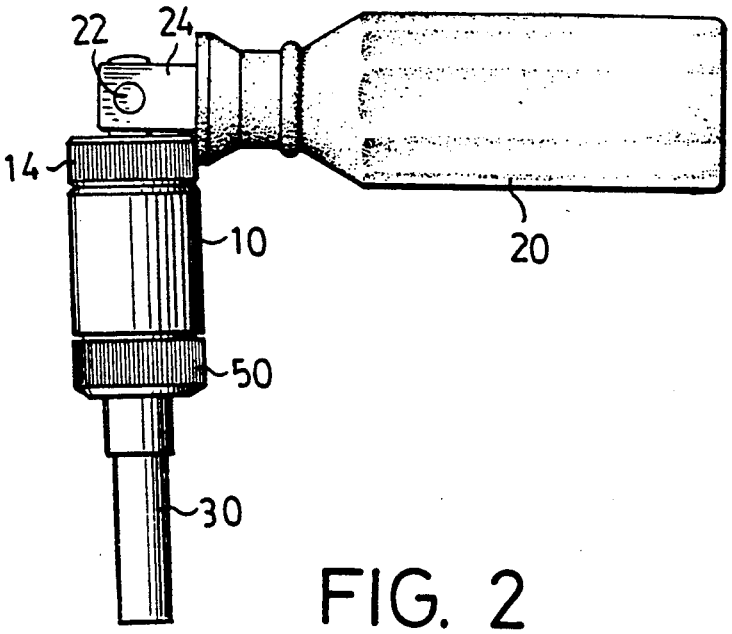

Referring to the drawings and initially to FIGS. and 2, a screw driver in accordance with the present invention comprises generally a sleeve 10 having a handle portion 20 pivotally coupled to a first end thereof by a pivot axle 22 and having a socket 30 engaged in a second end thereof so as to form a screw driver or to form a socket wrench. The sleeve 10 is rotatable relative to the handle portion 20 about the pivot axle 22. The sleeve 10 has a plurality of teeth 16 formed in the inner peripheral surface thereof.

Figure 3:
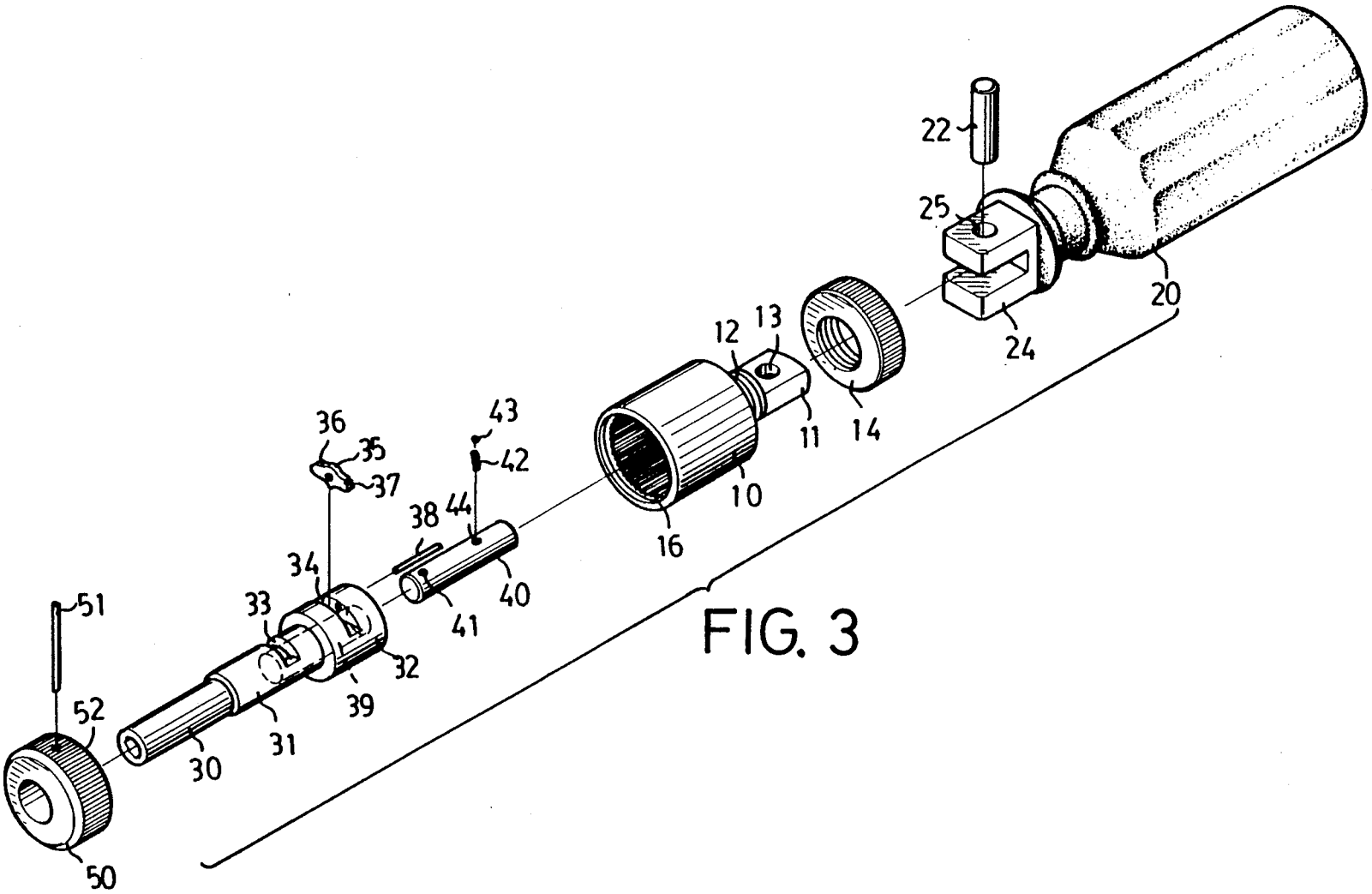
FIG. 3 is an exploded view of the screw driver.
Figure 4:
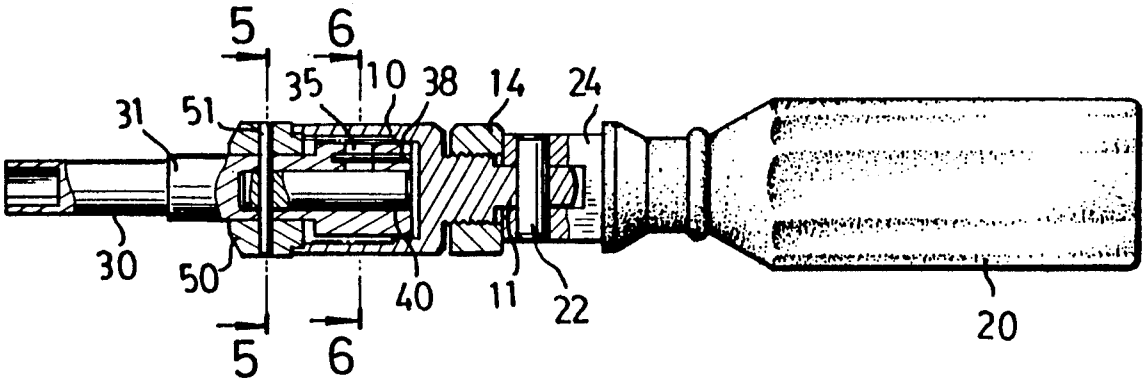
FIG. 4 is a cross sectional view taken along lines 4—4 of FIG. 1.

Referring next to FIGS. 3 and 4, two lugs 24 are integrally formed on one end of the handle portion 20 and each has a hole 25 formed therein. An extension 11 is integrally formed on the first end of the sleeve 10 and has a hole 13 formed therein and is engageable between the two lugs 24. The pivot axle 22 is engaged in the holes 25 of the lugs 24 and the hole 13 of the extension 11 so that the sleeve 10 and the handle portion 20 can be pivotally coupled together. An outer thread 12 is formed on the root portion of the extension 11. A control ferrule 14 is threadedly engaged on the outer thread 12 of the extension 11 so that the control ferrule 14 is movable longitudinally relative to the extension 11. When the control ferrule 14 moves toward the handle portion 20 and contacts the lugs 24 as shown in FIG. 4, the sleeve 10 is prevented from rotating relative to the handle portion 20 about the pivot axle 22

A shaft 31 has a head 32 formed integral on one end thereof. The socket 30 is formed integral to the other end of the shaft 31. The shaft 31 has a diameter larger than that of the socket and smaller than that of the head 32. The shaft 31 has a pair of notches 33 formed therein and the head 32 has an indent 34 formed therein. A pawl 35 has two abutments 36, 37 formed thereon and is rotatably supported in the indent 34 of the head 32 by a pin 38. A bore 39 is formed in the shaft 31 and the head 32 for receiving a rod 40 which has an aperture 41 formed in one end thereof and which has a spring 42 and a ball 43 engaged in a dent 44 thereof. The ball 43 is biased by the spring 42 to engage with the pawl 35. A knob 50 is slidably engaged on the shaft 31. A post 51 extends through the knob 50 and the notches 33 of the shaft 31 and is engaged in the aperture 41 of the rod 40 so that the rod 40 can be rotated by the knob 50. An annular flange 52 is formed on one side of the knob 50 and is rotatably engaged in the free end of the sleeve 10 by such as threading engagement so that the head 32 and the rod 40 can be rotatably retained in the sleeve 10.

Figure 5:
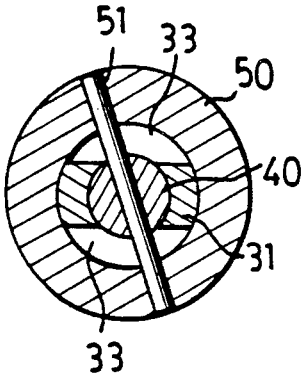
FIGS. 5 and 6 are cross sectional views taken along lines 5—5 and 6—6 of FIG. 4 respectively.
Figure 6:
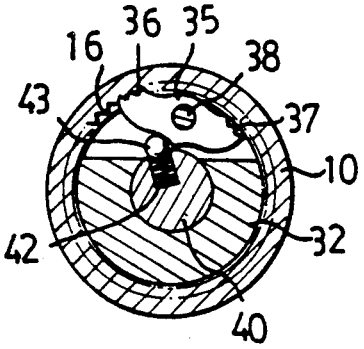

In operation, referring next to FIGS. 5 and 6, when the rod 40 is rotated counterclockwise by the knob 50, the pawl 35 will be urged by the ball 43 such that the abutment 36 of the pawl 35 is caused to engage with the teeth !6 of the sleeve 10. At this moment, the abutment 37 of the pawl 35 is not engaged with the teeth 16 of the sleeve 10 such that the sleeve 10 is rotatable counterclockwise relative to the head 32 and cannot rotate clockwise.

Figure 7:
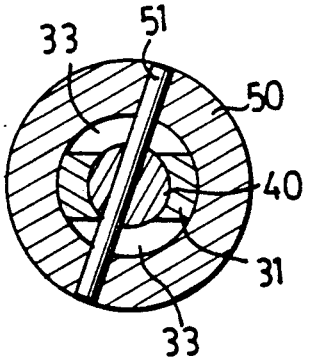
FIGS. 7 and 8 are cross sectional views similar to FIGS. 5 and 6, illustrating the operations of the screw driver.
Figure 8:
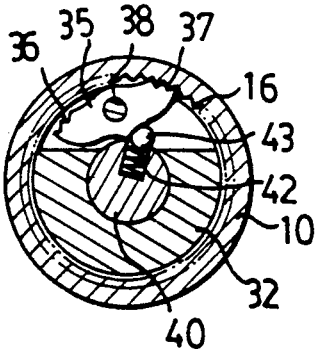

Referring next to FIGS. 7 and 8, when the rod 40 is rotated clockwise by the knob 50, the abutment 37 of the pawl 35 is caused to engage with the teeth 16 of the sleeve 10. At this moment, the abutment 36 of the pawl 35 is not engaged with the teeth 16 of the sleeve 10 such that the sleeve 10 is rotatable clockwise relative to the head 32 and the sleeve 10 cannot rotate counterclockwise relative to the head 32.

Accordingly, the active direction of the screw driver can be selected so that the screw driver can be continuously operated without disengagement from the screw.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A screw driver comprising a sleeve having a handle member coupled to a first end thereof and having an open second end and having a plurality of teeth formed in an inner peripheral surface thereof; a head rotatably received in said sleeve and having an indent formed therein; a pawl rotatably supported in said indent and having two abutments formed thereon; a shaft formed integral with said head and extended outward beyond said open second end of said sleeve and having a pair of notches formed therein; a socket formed integral with said shaft; a bore formed in said shaft and said head; a rod rotatably received in said bore and having an aperture and a dent formed therein; a spring and a ball received in said dent of said rod and arranged such that said ball is biased to engage with said pawl; a knob engaged on said shaft and rotatably coupled to said open second end of said sleeve; a post extended through said knob and said notches of said shaft and said aperture of said rod so that said rod can be caused to rotate by rotation of said knob; and a first abutment of said two abutments being caused to engage with said teeth of said sleeve when said rod is rotated in one direction; and a second abutment being caused to engage with said teeth of said sleeve when said rod is rotated in a reverse direction.

2. A screw driver of claim 1, wherein an extension is formed integral on said first end of said sleeve and has an outer thread formed in a root portion thereof close to said sleeve; two lugs are formed integral with said handle member; a control ferrule is threadedly engaged with said outer thread of said extension so that said control ferrule is movable longitudinally relatively along said extension; said extension is engaged between said lugs and is coupled to said lugs by a pivot axle so that said sleeve is rotatable about said pivot axle and is rotatable relative to said handle member; and said sleeve is prevented from rotating relative to said handle member when said control ferrule is moved toward said lugs.

* * * * *

UNITED STATES PATENT AND TRADEMARK OFFICE

CERTIFICATE OF CORRECTION

PATENT NO. : 5,142,953

DATED : September 1, 1992

INVENTOR(S) : Chi-Yen LIN

It is certified that error appears in the above-identified patent and that said Letters Patent is hereby corrected as shown below:

In Column 1, line 52, after the word "in" insert --accordance with--.

In Column 1, line 63, after "FIGS." add the numeral --1--.

In Column 2, line 22, after the numeral "22" insert a period --.--.

In Column 2, line 47, after the word "teeth" change "!6" to read --16--.

Signed and Sealed this

Twelfth Day of October, 1993

*Attest:*

*Attesting Officer*

Bruce Lehman

BRUCE LEHMAN

*Commissioner of Patents and Trademarks*